US007828564B2

(12) United States Patent
Guan et al.

(10) Patent No.: US 7,828,564 B2
(45) Date of Patent: Nov. 9, 2010

(54) CARD EDGE CONNECTOR WITH PICK-UP MEMBER

(75) Inventors: Hai-Fei Guan, Kunshan (CN); Lei Li, Kunshan (CN); Xue-Wu Bu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/322,239

(22) Filed: Jan. 29, 2009

(65) Prior Publication Data

US 2009/0191736 A1 Jul. 30, 2009

(30) Foreign Application Priority Data

Jan. 29, 2008 (CN) ..... 2008 2 0031815 U

(51) Int. Cl.
*H01R 13/62* (2006.01)

(52) U.S. Cl. ..... 439/135; 439/941; 439/160

(58) Field of Classification Search ..... 439/135, 439/940, 41, 160, 941
See application file for complete search history.

(56) References Cited

U.S. PATENT DOCUMENTS 5,026,295 A 6/1991 Fong et al.
5,249,977 A 10/1993 Tanaka et al.
6,019,617 A * 2/2000 Liu et al. ..... 439/135
6,174,171 B1 1/2001 Fu et al.
6,439,901 B1 8/2002 Ji et al.
6,506,064 B1 * 1/2003 Wu ..... 439/135
6,599,140 B1 * 7/2003 Chen et al. ..... 439/135
7,059,876 B2 * 6/2006 Zhang et al. ..... 439/135
7,153,147 B2 * 12/2006 Li et al. ..... 439/135
7,232,317 B2 * 6/2007 Ookura ..... 439/74
7,393,219 B2 * 7/2008 Liao ..... 439/135
2002/0058431 A1 * 5/2002 Li et al. ..... 439/135
2006/0094271 A1 * 5/2006 Zhang et al. ..... 439/135

FOREIGN PATENT DOCUMENTS

TW 555052 9/2003

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A card edge connector for receiving a module, includes an elongated insulative housing having a pair of side walls, a central slot extending therebetween for insertion of the module, a plurality of terminals positioned in the side walls and extending into the central slot; and a pick-up member having a fixing portion and a connect portion connecting the fixing portion. the insulative housing includes a latch pair of portions formed on opposite ends thereof and disposed at an outer sides of the terminals along a lengthwise direction thereof, the latch portion fixes with the fixing portion of the pick-up member.

19 Claims, 8 Drawing Sheets

CARD EDGE CONNECTOR WITH PICK-UP MEMBER

BACKGROUND OF THE INVENTION

1. Field of the Invention

The present invention generally relates to a card edge connector for receiving a module and more particularly to a card edge connector with an improved pick-up member for being adsorbed by a suction device.

2. Description of Related Art

As the trend of the computer industry continues toward miniaturization, more parts are arranged in a smaller space inside the computer. This is particularly true for notebook computers. To meet such a requirement, a number of circuit boards are stacked on top of each other inside the computer and each circuit board has as many electronic elements mounted thereon as possible. To arrange as many electronic elements as possible on a particular circuit board and to accommodate as many circuit boards as possible inside the computer, the electronic elements must be as space efficient as possible. Among the electronic elements mounted on the computer circuit boards, electrical connectors occupy a significant amount of space and miniaturization of the electrical connector is effective in more fully exploiting the space inside the computer.

A size-reduced or minimized connector requires a corresponding reduction in size of the conductive traces on the circuit board. This makes it more difficult to properly retain the connector at its correct position on the circuit board in order to proceed with a soldering process which permanently fixes the connector to the circuit board.

Conventionally, the connector is temporarily retained on the circuit board is by means of a suction force from a vacuum until the soldering process is complete. To use the vacuum to retain the connector, the connector must have a flat surface with which a suction cup may be engageable. Traditionally, the flat surface is provided by a plate-like member, commonly referred to as pick-and-place plate, releasably fixed to the connector by means of adhesive film or tape or by using resilient clips which engage with terminals of the connector. Examples are shown in U.S. Pat. Nos. 6,439,901, 5,249,977 and 5,026,295. When using the pick-and-up plate to secure the connector, the pick-and-up is sandwiched by terminals of connectors, thus may damage the terminals.

Hence, an improvement over the prior art is required to overcome the problems thereof.

SUMMARY OF THE INVENTION

According to one aspect of the present invention, a card edge connector for receiving a module, includes an elongated insulative housing having a pair of side walls, a central slot extending therebetween for insertion of the module, a plurality of terminals positioned in the side walls and extending into the central slot, and a pick-up member having a fixing portion and a connect portion connecting the fixing portion. The insulative housing includes a pair of latch portions formed on opposite ends thereof and disposed at an outer sides of the terminals along a lengthwise direction thereof. The latch portions fix with the fixing portion of the pick-up member.

According to another aspect of the present invention, a card edge connector for receiving a module, includes an elongated insulative housing having a pair of side walls, and a central slot extending therebetween for insertion of a module, a plurality of terminals positioned in the side walls and extending into the central slot, and a pick-up member having a connect portion disposed above the insulative housing, a end wall, and a pair of side walls connecting to the end wall. Both of the end wall and the pair of side walls extend downwardly from the connect portion and define a locating space therebetween. The insulative housing includes a pair of latch portions formed on opposite ends thereof and disposed at an outer sides of the terminals along a lengthwise direction thereof. The latch portions are retained in the locating space of the pick-up member.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
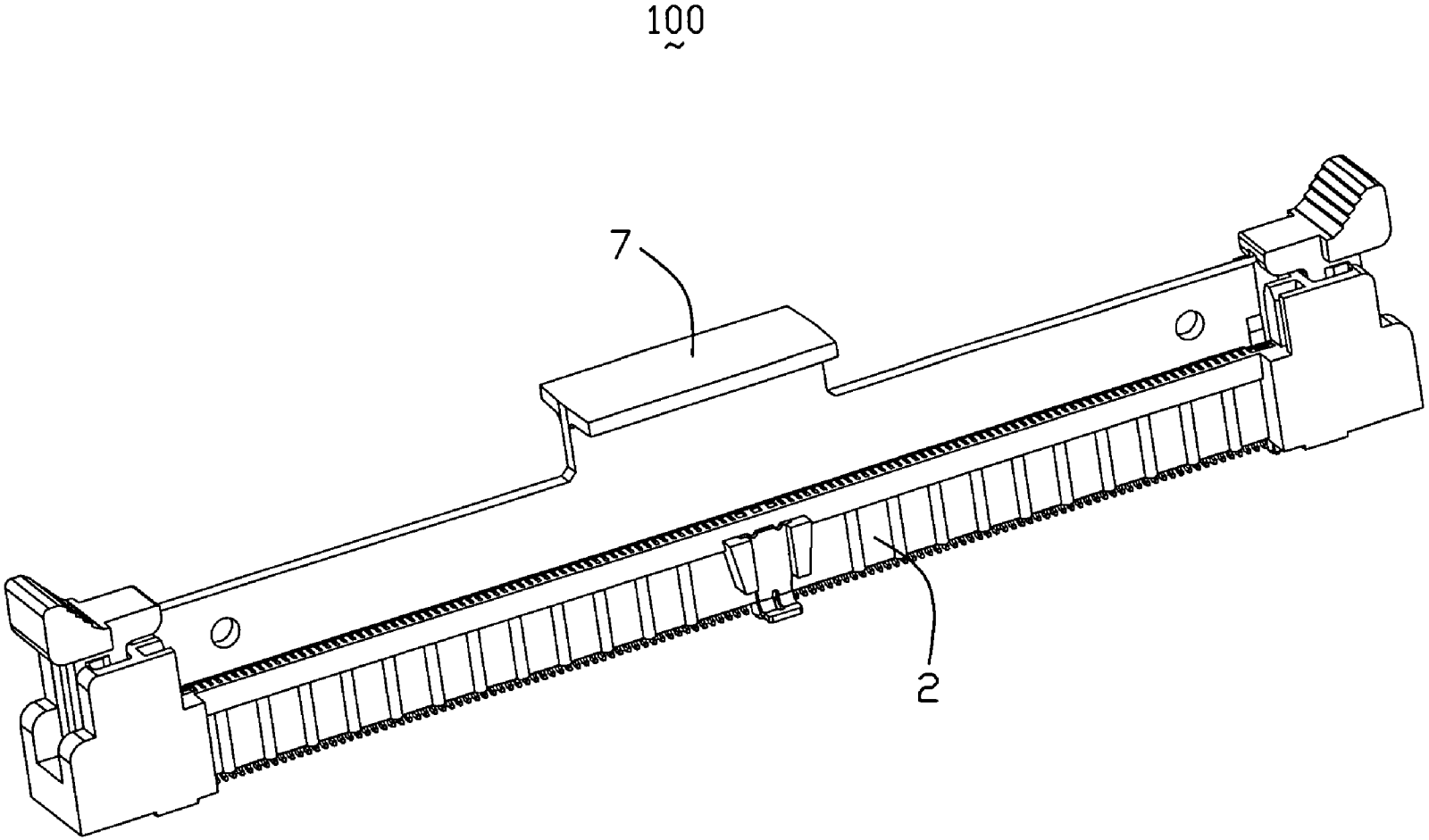
FIG. 1 is a perspective view of a card edge connector in accordance with a first embodiment of the present invention.
Figure 2:
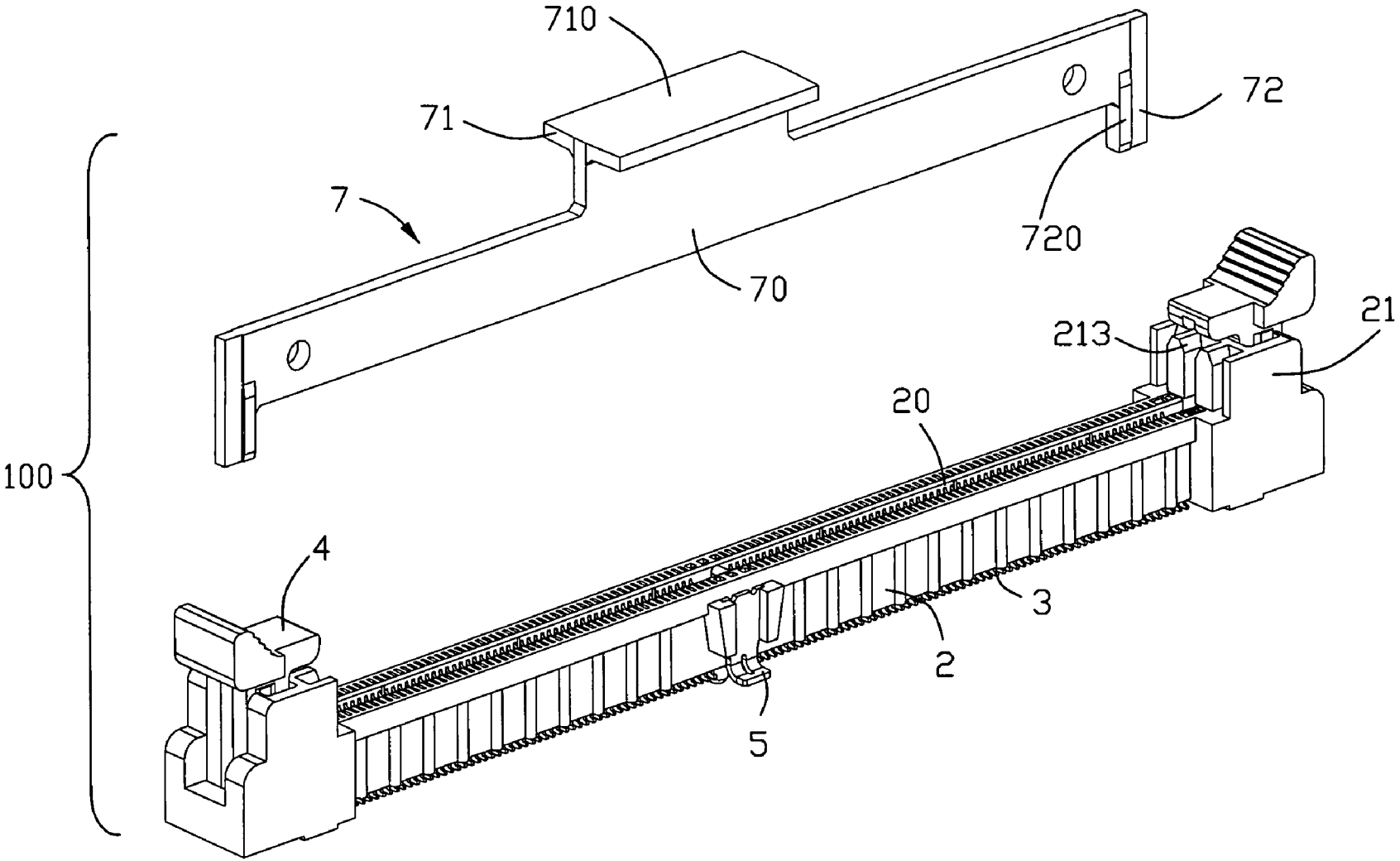
FIG. 2 is a perspective view of a pick-up member separated form a insulative housing of the card edge connector shown in FIG. 1.
Figure 3:
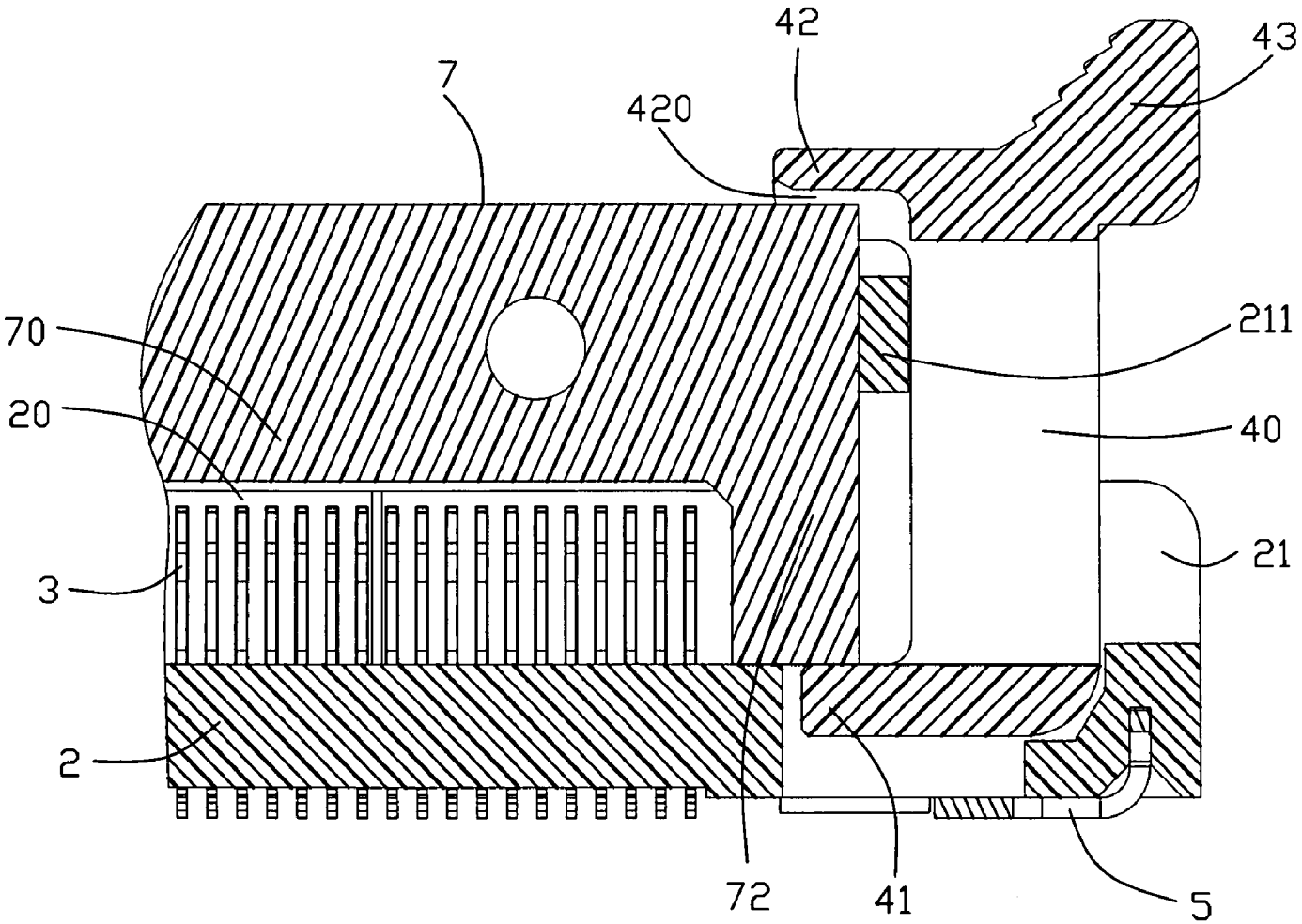
FIG. 3 is a cross-sectional view of the card edge connector shown in FIG. 1.
Figure 4:
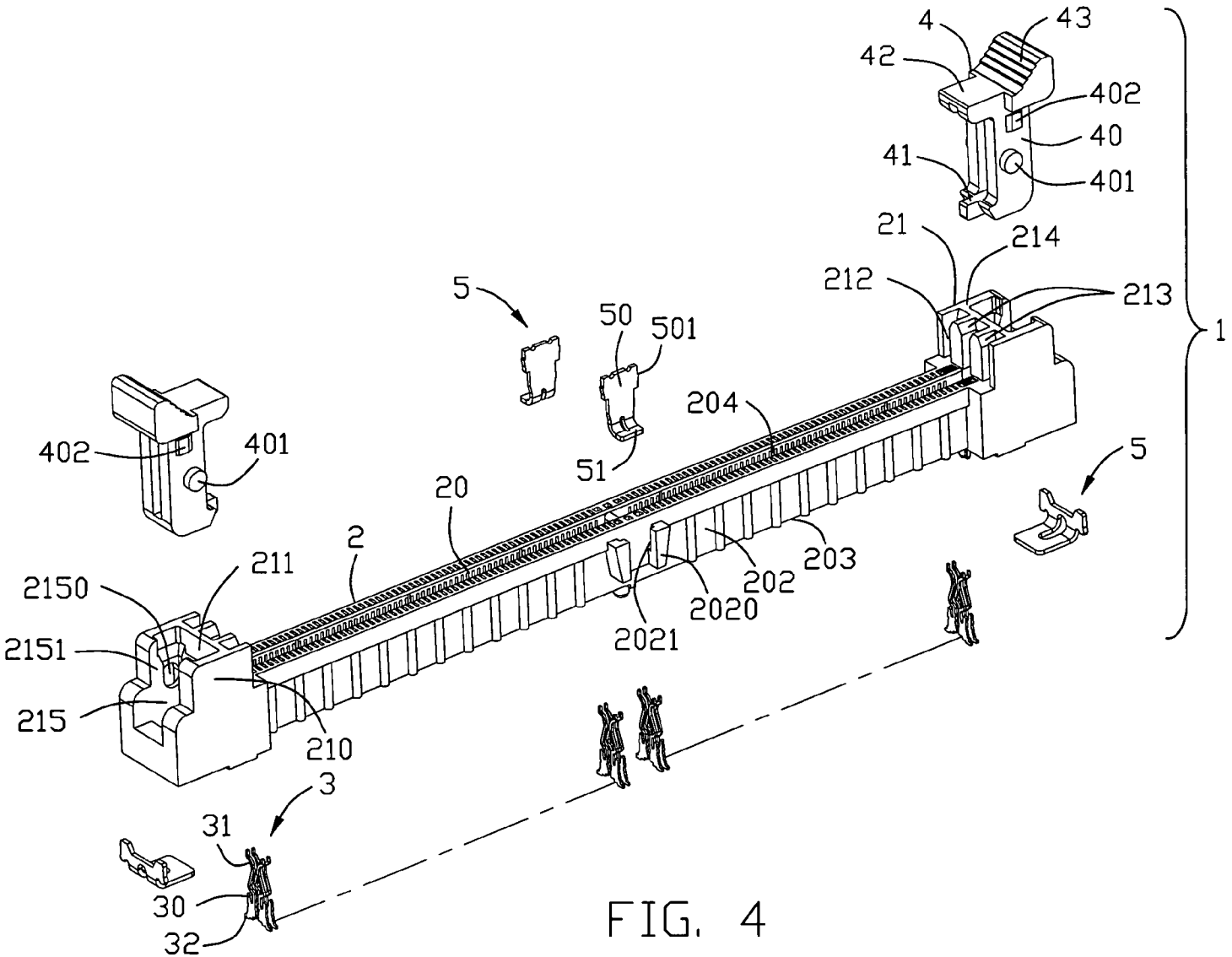
FIG. 4 is an exploded view of the card edge connector shown in FIG. 1.
Figure 5:
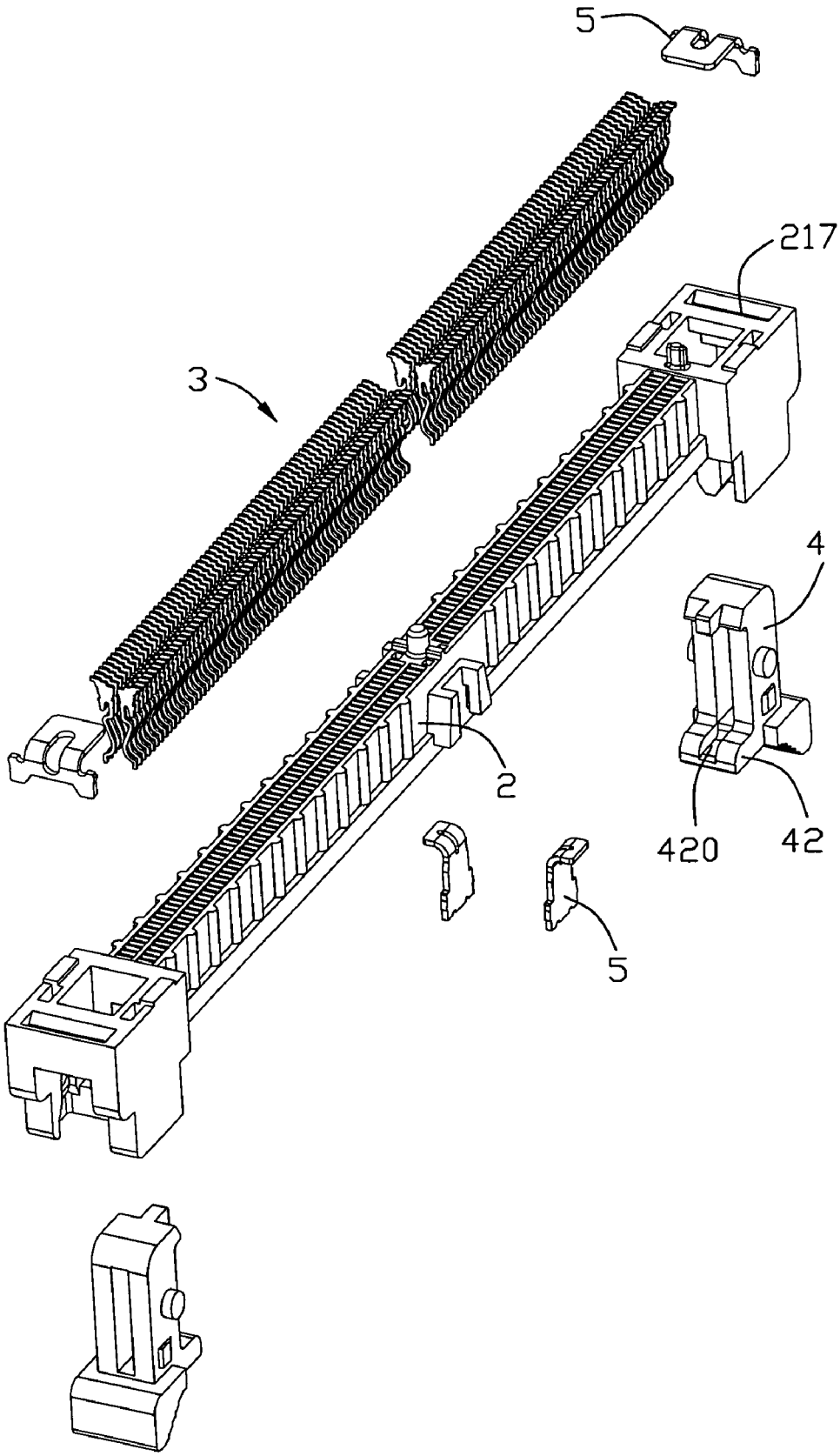
FIG. 5 is another exploded view of the card edge connector shown in FIG. 1.

Reference will now be made to the drawing figures to describe the preferred embodiment of the present invention in detail. Referring to FIGS. 1-5, the card edge connector 100 constructed in accordance with a first embodiment of the present invention, includes an elongated insulative housing 2, a plurality of terminals 3 mounted on the insulative housing 2, a pair of ejectors 4 pivoted on opposite ends of the insulative housing 2, two pair of metal mounting plates 5 located in the insulative housing 2 for mounting to a PCB (not shown), and a pick-up member 7 fixed on the insulative housing 2.

The insulative housing 2 has a central slot 20 for receiving a module (not shown) and two latch portions 21 disposed on opposite ends and at an outer side of the terminals 3 along a lengthwise direction thereof. The central slot 20 defines a pair of elongated side walls 202 formed with a plurality of channels 204 for receiving the terminals 3, and a bottom wall 203. The channels 204 extend through the bottom wall 203. The terminals 3 are retaining in the channels 204 respectively and extend into the central slot 20. The pair of side walls 202 each defines a mounting block 2020 protruding from an outer surface thereof and a first mounting slot 2021 recessed on the mounting block 2020. The latch portions 21 each includes a pair of side portions 210, a reinforcement wall 211 connecting the side portions 210 therebetween, and a pair of latch slots 212 parallel to the central slot 20. The latch portion 21 defines a number of incline surfaces 213 disposed at a top portion thereof for guiding insertion of the module and the pick-up member 7.

The latch portion 20 defines a receiving space 215 communicating with the central slot 20 for receiving the ejector 4. An upper portion of the receiving space 215 is separated from the central slot 20 and the latch slots 212 by the reinforcement wall 211. The side portions 210 has a pair of holes 2150 communicating with the corresponding receiving space 215. The latch portion 20 further defines a second mounting slot 217 disposed on a bottom portion thereof in order to mount the mounting plate 5.

Each ejectors 4 includes a main body 40 retained in the receiving space 215 and having a pair of spindles 401 formed on opposite sides thereof for rotatably insertion into the holes 2150 of the insulative housing 2. The ejector 4 has an ejecting portion 41 extending inwardly from a lower end of the main body 40, a locking portion 42 extending from an upper end of the main body 40 and toward the central slot 20, and an actuating portion 43 extending outwardly from the upper end of the main body 40 for facilitating urging the ejector 4. The locking portion 42 defines a depression 420 toward the bottom portion of the latch portion 21.

Each mounting plates 5 includes a retaining portion 50 retained in the first and second mounting slots 2021, 217 and a soldering leg 51 extending out of the insulative housing 2 to be mounted to the PCB.

The pick-up member 7 includes a connect portion 70, a flat pick portion 71 disposed above the connect portion 70 and perpendicular to the connect portion 70, and a pair of fixing portion 72 extending downwardly form opposite ends of the connect portion 70. The pick portion 71 defines a top flat surface 710 to be adsorbed by a pick-up device. The fixing portion 72 defines two ribs 720 disposed on opposite outer surfaces thereof.

While the card edge connector 100 is being soldered on the PCB, the fixing portion 72 of the pick-up member 7 fixes with the latch portion 21 of the insulative housing 2. The ribs 720 of the fixing portion 72 abut against opposite inner walls of the latch portion 21. The connect portion 71 is disposed above the central slot 20 of the insulative housing 2. Therefore, the pick-up member is disposed offset from the terminals 3. Thus the terminals 3 could not be damaged by the pick-up member 7. The reinforcement wall 211 is disposed at an outer side of the fixing portion 72 for preventing the pick-member from moving along a left-to-right direction. A top end of the connect portion 71 is received into the depression 420 of the locking portion 42 of the ejector 4 for preventing the pick-up member 7 form moving upwardly. A lower end of the fixing portion 72 is abutted against by the ejection portion 41, in this way, a side edge of the pick-up member 7 is retained between the locking portion 42 and the ejecting portion 41. The suction device absorbs the flat surface 710 of the pick portion 71 and positions the card edge connector 100 at its correct position on the PCB in order to proceed with a soldering process which permanently fixes the card edge connector 100 to the PCB. While the pick-up member 7 is to be ejected out of the insulative housing 2, the actuating portion 43 is pulled downwardly and drives the ejector 4 rotatable to another position at which the ejecting portion 41 ejects the fixing portion 72 to moving upwardly out of the latch portion 21.

Figure 6:
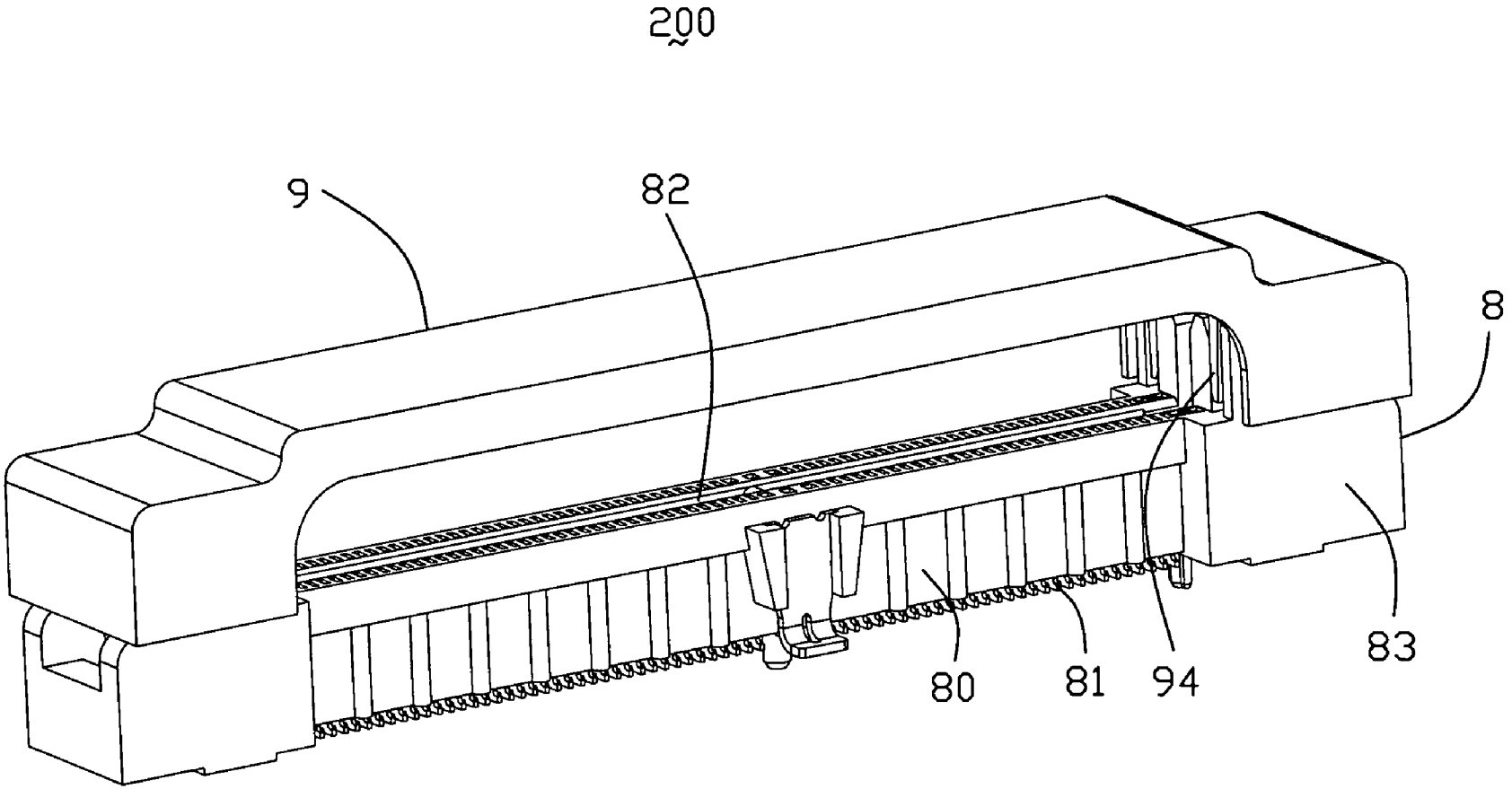
FIG. 6 is a perspective view of a card edge connector in accordance with a second embodiment of the present invention.
Figure 7:
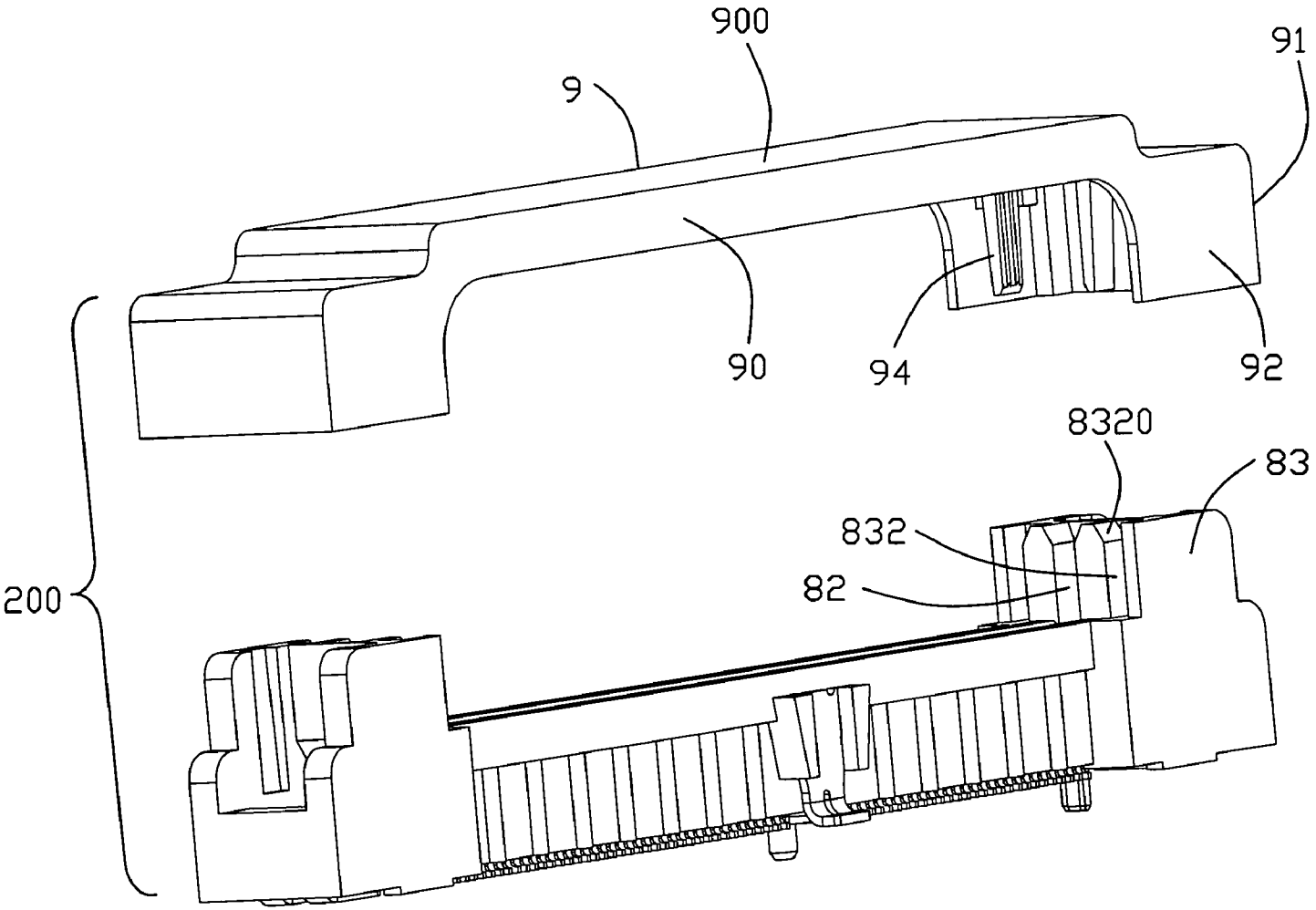
FIG. 7 is a perspective view of a pick-up member separated from an insulative housing of the card edge connector shown in FIG. 6.
Figure 8:
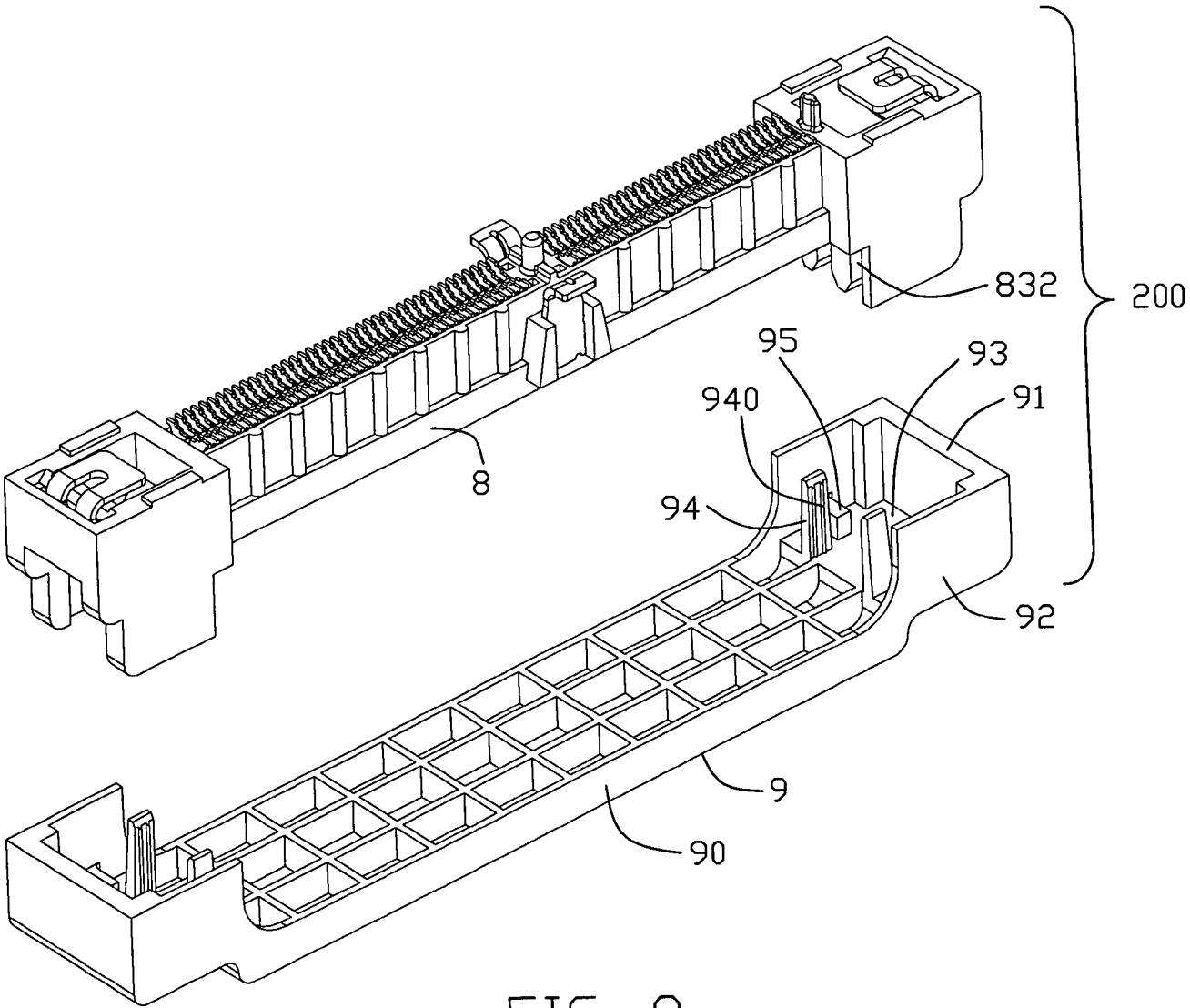
FIG. 8 is another perspective view of a pick-up member separated from the insulative housing of the card edge connector shown in FIG. 6.

As shown in FIG. 6-8, a second embodiment of the card edge connector 200 is similar to the first embodiment shown in FIGS. 1-5, and differs in that a pick-up member 9 has a pair of fixing portions 94 retained in the pair of latch slots 832 of the latch portion 83 respectively, a pair of side walls 92, and a end wall 91 which all extending downwardly from the connect portion 90. The pair of side walls 92 and the end wall 91 define a locating space 93 therebeween. The connect portion 90 has a top flat surface 900 to be absorbed by the suction device. The latch slots 832 are parallel to the central slot 82 and have an incline surface 8320 for guiding insertion of the fixing portions 94. The fixing portions 94 have a number of ribs 940 abutting against opposite inner wall of the latch slots 832. The latch portion 82 is retained in the locating space 93 after the fixing portion portions 94 inserting into the latch slots 832. The pick-up member 7 defines a protrusion 95 connecting the side walls 92 with a top inner wall thereof for increasing strength thereof. The protrusion 95 is sandwiched between the connect portion 90 and the latch portion 83.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a module, comprising:

an elongated insulative housing having a pair of side walls, and a central slot extending therebetween for insertion of the module;

a plurality of terminals positioned in the side walls and extending into the central slot; and a pick-up member having a pair of fixing portions and a connect portion connected to and between the fixing portions; wherein the insulative housing includes a pair of latch portions formed on opposite ends thereof and respectively disposed beside the terminals along a lengthwise direction thereof, and the latch portions fix the fixing portions of the pick-up member.

2. The card edge connector as claimed in claim 1, wherein the pick-up member includes a pick portion extending upwardly from the connect portion, and the pick portion defines a flat surface to be absorbed by a suction device.

3. The card edge connector as claimed in claim 1, wherein the connect portion is disposed above the central slot, the fixing portions respectively extend downwardly from opposite ends of the connect portion, each of the latch portions defines an inner side wall, and each of the fixing portions defines a rib abutting against the inner side wall of the corresponding latch portion.

4. The card edge connector as claimed in claim 1, wherein each of the latch portions has a latch slot defining an inclined surface therein for guiding insertion of the fixing portion.

5. The card edge connector as claimed in claim 1, wherein each of the latch portions includes a reinforcement wall disposed at an outer side of the central slot for preventing the pick-up member from moving outwardly.

6. The card edge connector as claimed in claim 1, wherein the card edge connector includes a pair of ejectors respectively pivoted on the corresponding latch portions, each of the ejectors includes a main body, an ejecting portion for pushing the fixing portion away from the latch portion of the insulative housing, an actuating portion and a locking portion for locking the pick-up member or the module, the ejecting portion extends inwardly from a lower end of the main body, the locking portion protrudes inwardly from the main body, and the actuating portion extends outwardly from the main body.

7. The card edge connector as claimed in claim 6, wherein the locking portion of each of the ejectors defines a depression to retain a top end of the connect portion for preventing the pick-up member from moving upwardly.

8. The card edge connector as claimed in claim 1, wherein each of the latch portions includes a pair of latch slots parallel to the central slot, each of the pair of latch slots defines a pair of inner side walls, and each of the fixing portions is retained in the corresponding latch slot and sandwiched between the corresponding inner side walls.

9. The card edge connector as claimed in claim 1, wherein the pick-up member includes, at each of opposite ends, a pair of side walls and a end wall which all extend downwardly from the connect portion, and all the side walls and the end wall of the pick-up member enclose the corresponding fixing portion.

10. The card edge connector as claimed in claim 9, wherein the pick-up member, at each of the opposite ends, forms a locating space among the side walls and the end wall, and each of the latch portions is retained in the corresponding locating space.

11. A card edge connector for receiving a module, comprising:

an elongated insulative housing having a pair of side walls, and a central slot extending therebetween for insertion of the module;

a plurality of terminals positioned in the side walls and extending into the central slot; and a pick-up member having a connect portion disposed above the insulative housing, and having, at each of opposite ends, an end wall, and a pair of side walls connecting to the end wall, wherein all of the end wall and the pair of side walls extend downwardly from the connect portion and commonly define a locating space therein; wherein the insulative housing includes a pair of latch portions formed on opposite ends thereof and disposed beside the terminals along a lengthwise direction thereof, wherein each of the latch portion is retained in the corresponding locating space of the pick-up member.

12. The card edge connector as claimed in claim 11, wherein the pick-up member defines a pair of fixing portions extending downwardly from the connect portion and disposed in the locating space, and the latch portion has a pair of latch slots parallel to the central slot and at opposite sides of the central slot along a transverse direction perpendicular to the lengthwise direction, wherein the fixing portions are retained in the pair of latch slots, respectively.

13. An electrical connector assembly comprising:

an insulative housing including a primary body defining an elongated central slot along a lengthwise direction;

two rows of contacts disposed by two lateral sides of the central slot in a transverse direction perpendicular to said lengthwise direction;

a pair of towers located at two opposite lengthwise ends of the housing with therein at least one latch slot extending parallel to said central slot under condition of no contacts being located in the towers; and a pick up cap defining a main body extending along said lengthwise direction with a pair of fixing portions at two opposite lengthwise ends of the pick up cap, a planar horizontal suction section formed around a middle portion of the main body; wherein said fixing portion is engaged with the corresponding latch slot in an interference fit for retaining the pick up cap to the housing under condition of no portion of the pick up cap being received in the central slot in the primary body.

14. The electrical connector assembly as claimed in claim 13, wherein the latch slot is aligned with the central slot and essentially an end section of the central slot, and said main body is a vertical planar piece perpendicular to said suction section.

15. The electrical connector assembly as claimed in claim 14, further including a pair of ejectors each having a locking head, which is used for locking into a notch of a memory module inserted into the central slot, downwardly pressing against the pick up cap for holding the pick up cap in position with regard to the housing.

16. The electrical connector assembly as claimed in claim 15, wherein said ejector further includes a kicking leg opposite to the corresponding locking head for ejecting the pick up cap outward out of the central slot.

17. The electrical connector assembly as claimed in claim 13, wherein said latch slot is offset from the central slot, and the main body essentially includes a horizontal plane transversely extending with a dimension to sufficiently vertically cover the primary body of the housing fully in both said lengthwise direction and said transverse direction.

18. The electrical connector assembly as claimed in claim 17, wherein said pick up cap further includes a plurality of vertical side walls surrounding the corresponding towers.

19. The electrical connector assembly as claimed in claim 17, wherein the suction section is essentially a part of the horizontal plane of the main body.

* * * * *